US007475647B2

(12) United States Patent
Weinberg et al.

(10) Patent No.: US 7,475,647 B2
(45) Date of Patent: Jan. 13, 2009

(54) SEWING MACHINE FOR STITCHING WITH A COMPOSITE THREAD

(75) Inventors: Amotz Weinberg, Tel Aviv (IL); Yair Eilam, Tel Mond (IL)

(73) Assignee: Shenkar College of Engineering and Design, Ramat Gan (IE)

( * ) Notice: Subject to any disclaimer, the term of this patent is extended or adjusted under 35 U.S.C. 154(b) by 181 days.

(21) Appl. No.: 11/185,978

(22) Filed: Jul. 21, 2005

(65) Prior Publication Data

US 2006/0112865 A1 Jun. 1, 2006

(30) Foreign Application Priority Data

Jul. 21, 2004 (IL) ..... 163135

(51) Int. Cl.
*D05B 47/00* (2006.01)
*D05B 85/00* (2006.01)
*D05B 69/00* (2006.01)

(52) U.S. Cl. ..... 112/221; 112/254; 112/302

(58) Field of Classification Search ..... 112/220, 112/221, 254, 302, 98, 116, 170, 475.01, 112/173, 80.02; 223/102
See application file for complete search history.

(56) References Cited

U.S. PATENT DOCUMENTS 2,491,457 A * 12/1949 Sigoda ..... 112/98
2,506,432 A * 5/1950 Philip ..... 112/116
3,207,107 A * 9/1965 Ferre ..... 112/170
3,834,599 A * 9/1974 Herr ..... 223/102
3,922,982 A * 12/1975 Conti ..... 112/222
4,122,787 A * 10/1978 Conti ..... 112/170
4,757,775 A 7/1988 Leska, Sr.
5,333,562 A * 8/1994 LeMaire et al. ..... 112/475.01
5,398,627 A 3/1995 Nishikawa
5,513,587 A 5/1996 Takada et al.
5,515,798 A 5/1996 Cahuzac
5,759,321 A 6/1998 Cahuzac
5,816,175 A 10/1998 Teramoto
5,829,373 A 11/1998 Baxter
6,055,920 A 5/2000 Hori
6,101,961 A 8/2000 Sakuma
6,145,457 A 11/2000 Imaeda et al.
6,595,150 B2 7/2003 Yamazaki
6,644,228 B2 * 11/2003 Valle et al. ..... 112/173
6,645,333 B2 11/2003 Johnson et al.
6,729,251 B2 5/2004 Nishikawa et al.
7,168,377 B2 * 1/2007 Fukuyama ..... 112/80.02

* cited by examiner

*Primary Examiner*—Ismael Izaguirre
(74) *Attorney, Agent, or Firm*—Pearl Cohen Zedek Latzer, LLP

(57) ABSTRACT

The present invention provides a sewing mechanism which is useful for joining fabrics with a brittle thread. The invention provides a sewing mechanism having a needle for stitching a brittle fiber thread through at least one layer of a fibrous fabric, the mechanisms for supplying the sewing thread to the needle on each edge thereof while the needle penetrates the layer or layers of fibrous fabric, thread supply being controlled to equalize the supply on both sides of the needle to prevent axial movement of the thread relative to the needle while the needle moves downwards. The mechanism further supports a revolving spool of a second thread and arranged to insert the second thread through a loop formed by the sewing thread at the remote side of the layer of fibrous fabric.

13 Claims, 5 Drawing Sheets

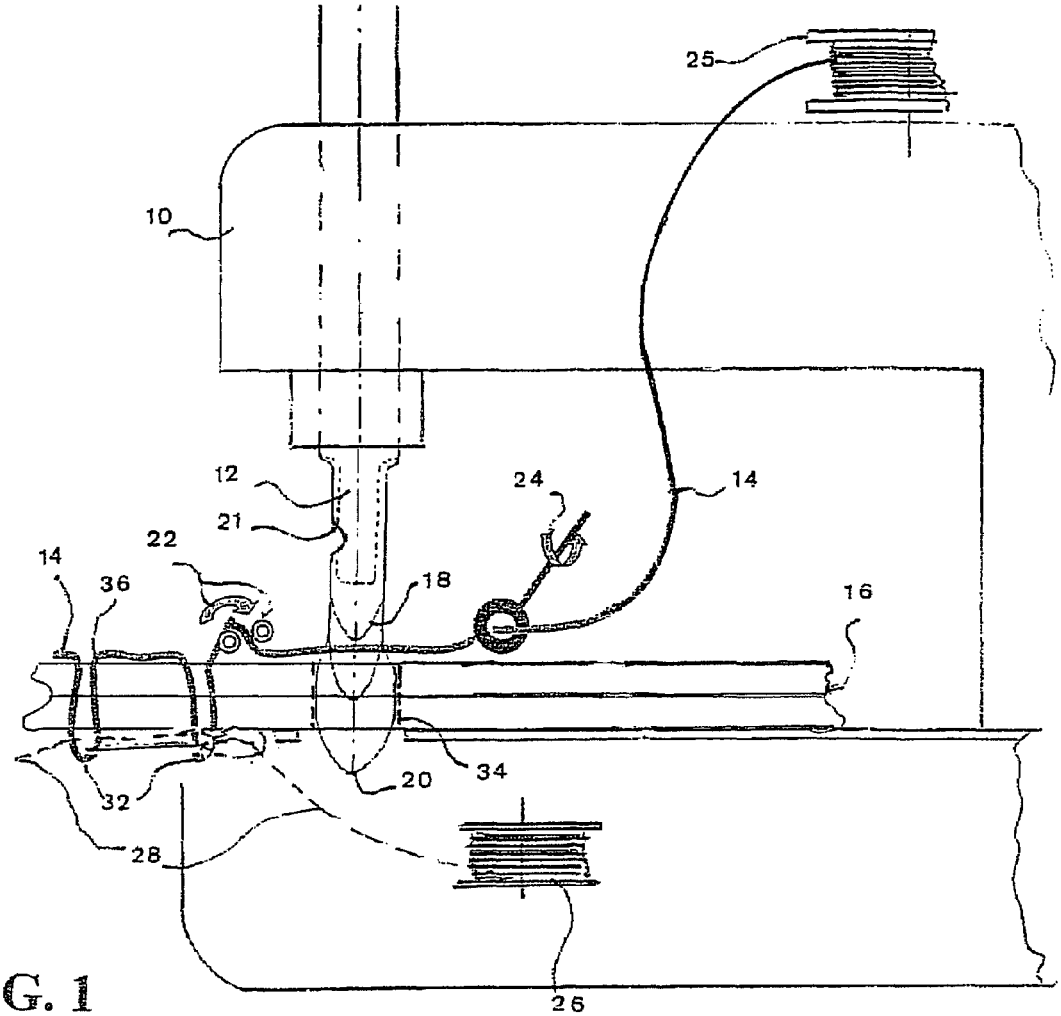
FIG. 1
FIG. 2
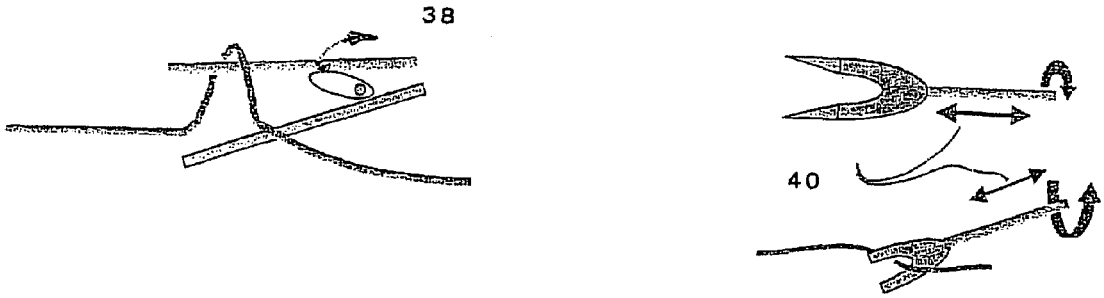

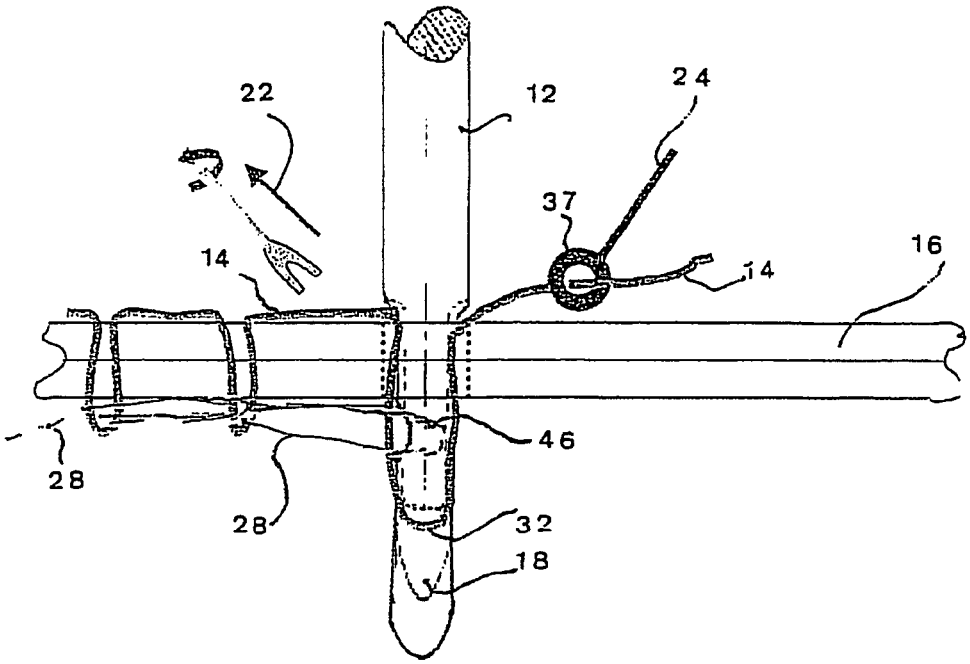
FIG. 3
FIG.4
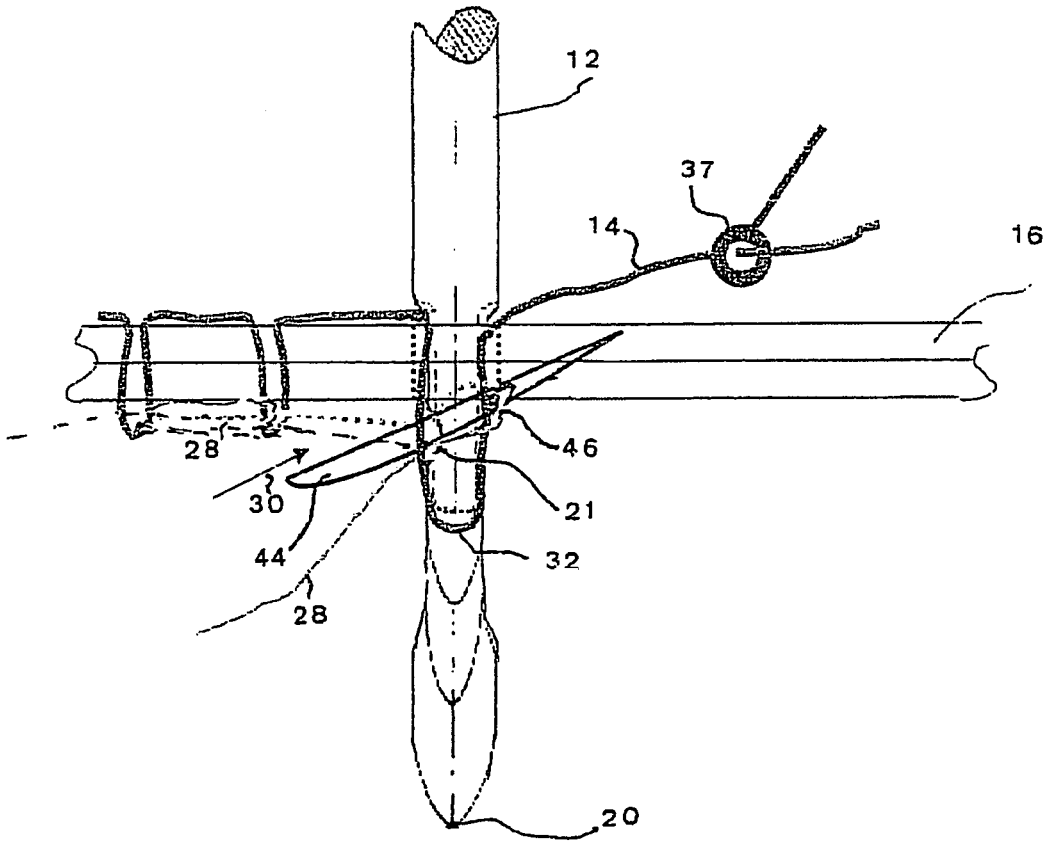

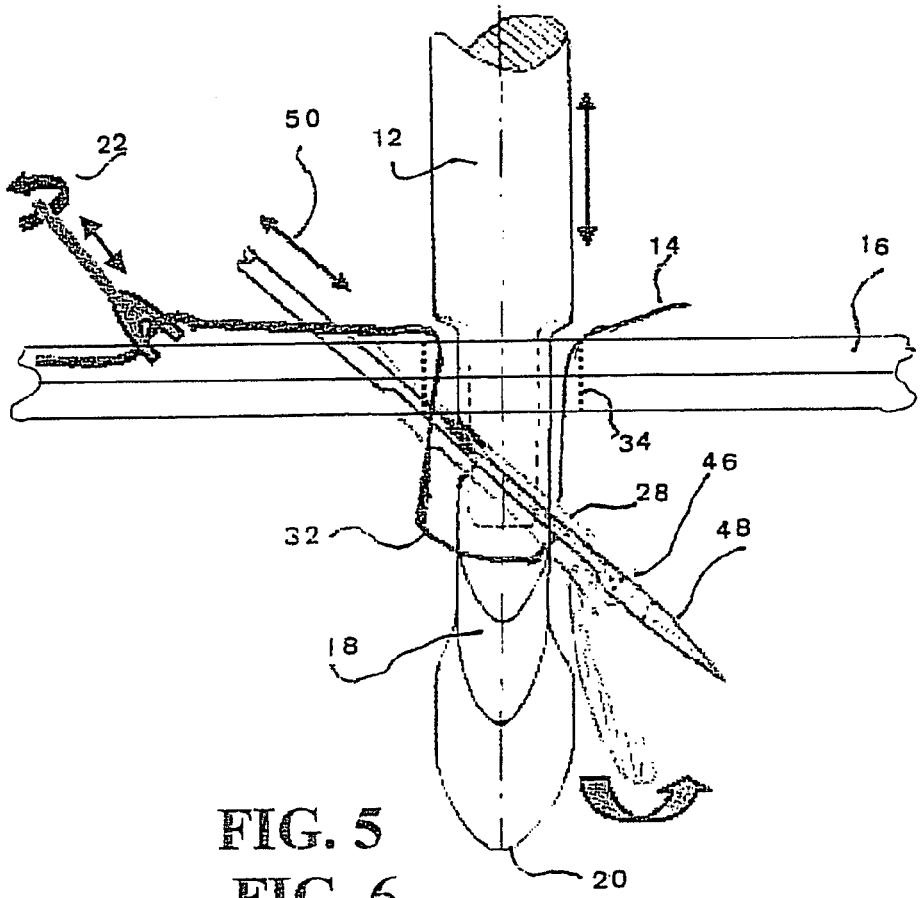
FIG. 5
FIG. 6
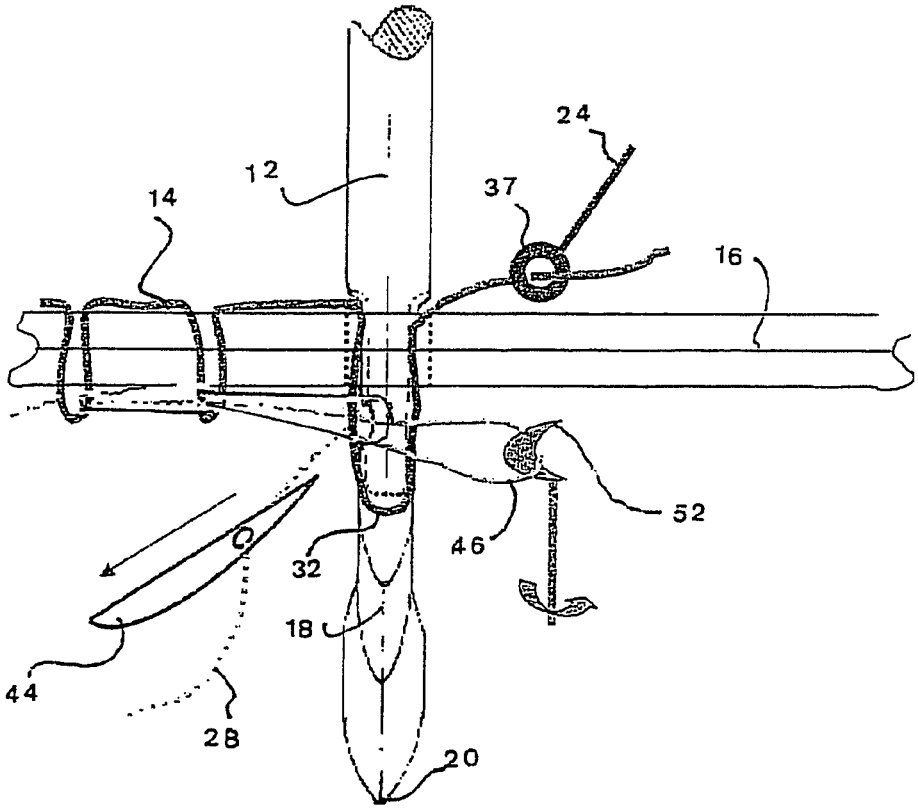

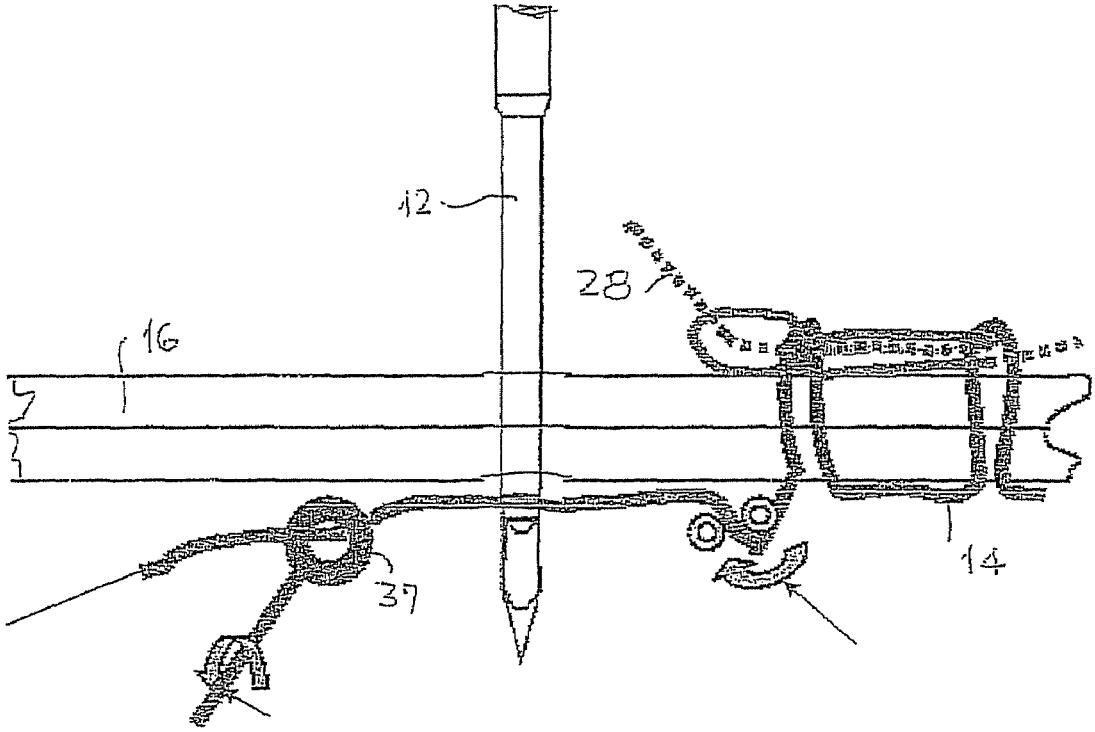
FIG. 8
FIG. 9
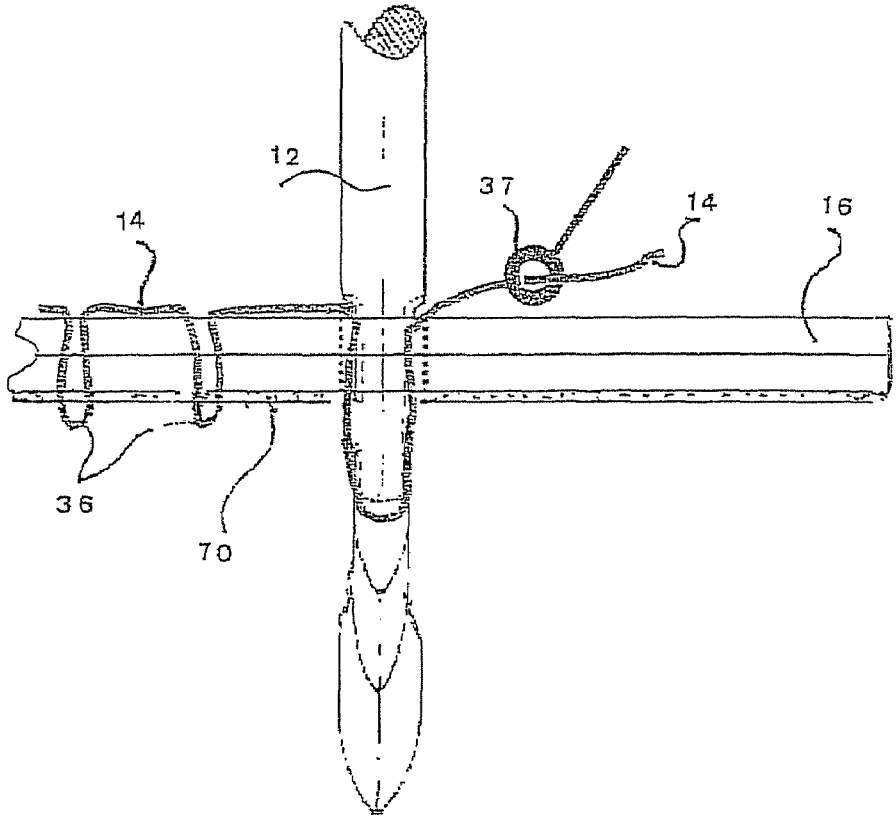

SEWING MACHINE FOR STITCHING WITH A COMPOSITE THREAD

CROSS REFERENCE TO RELATED APPLICATIONS

This application claims the benefit of IL Ser. No. 163135, filed on Jul. 21, 2004 which is incorporated in their entirety herein by reference.

BACKGROUND AND FILED OF INVENTION

The present invention relates to the joining of fabrics made of advanced fibers for making pre-forms for composite materials.

More particularly, the invention provides a sewing mechanism which is useful for joining fabrics with a brittle thread.

In the present specification, as in other prior documents, the terms "severing thread" "brittle fiber thread" "advanced fiber thread" "high performance threads" "technical fiber" are used interchangeably to designate a thread made from glass, ceramic, graphite or carbon fibers of a commercially or experimentally available type. No novelty is claimed here regarding the thread.

Optimum stitching results using the said mechanism according to the present invention are obtained when the sewing needle, which is described in our co-pending application which is hereby incorporated herein by reference, is used.

Composite fiber-reinforced materials are widely used wherever a high strength/weight ratio is needed, typically in aerospace vehicles, sports equipment, and to a lesser extent in land and sea vehicles and their equipment. Glass and carbon fibers have long been used for reinforcing other materials called matrices, particularly polyester, epoxy and other thermosetic and thermoplastic polymers, in order to obtain high performance composite materials. However the joining of layers of reinforcing fibrous materials can be difficult, as joining methods applicable to textile materials are generally inapplicable to high performance fabrics and yarns. Reliable joining techniques are needed also for these advanced materials in order to carry out tasks such as producing a multi-layer or lamina pre-form which subsequently is impregnated with the resin that turns to be the matrix.

High strength threads are preferred for sewing together sheets of high performance fibrous layers. Threads based on carbon or glass fibers are commercially available. It has however been found that when sharply bent or when friction is applied, such yarns tend to break. The standard sewing machines apply very sharp bends to the threads as well as friction with the sewing needle eye during the sewing process hens they are inadequate for stitching with brittle yarns.

The state of the art can be assessed by a review of the following recent US Patents.

Leska Sr. discloses a chain stitching apparatus in U.S. Pat. No. 4,757,775 for reinforcing or attaching composite materials. This design is intended to keep all critical parts on the upper side of the material. No mention is made about prevention of brittle thread breakage.

A further stitching head proposed by Cahuzak is disclosed in U.S. Pat. No. 5,515,798, also without means for preventing the sharp bends liable to break a composite thread. The same inventor also details a method for reinforcing a sheet for a composite component in U.S. Pat. No. 5,759,321.

In U.S. Pat. No. 5,333,562 LeMaire et al. propose a method of stitching a fabric using a composite thread to produce a fiber-matrix piece. The needle thread is flexible, while the shuttle thread is composite.

Baxter discloses a blind stitching apparatus featuring a curved needle seen in U.S. Pat. No. 5,829,373. The stitches are placed at discrete locations to join pre-forms to make a composite component.

A sewing machine with both needle and bar rocking and thread tension releasing mechanisms actuated by a single actuator is disclosed by Hori in U.S. Pat. No. 6,055,920.

Sakuma in U.S. Pat. No. 6,101,961 proposes a rather complex mechanism for thread feeding intended for high speed sewing. Upstream grippers grip both upper and lower looper threads and close during stitch forming while opening when the cloth is moved. Downstream grippers also grip the threads but open during stitch forming and close when the cloth is moved.

In U.S. Pat. No. 6,145,457 Imaeda et al. disclose a sewing machine which includes mechanisms for adjusting and releasing thread tension. By driving a cam rod holding several cans, a single motor is used to drive the various mechanisms.

Yamazaki in U.S. Pat. No. 6,595,150 B2 describes a pneumatically-operated thread tension controller including a solenoid valve, a microcomputer, an air-pressure regulator and a pneumatic cylinder driving thread tension disks.

Johnson et al. in U.S. Pat. No. 6,645,333 disclose a method for inserting z-axis reinforcing fibers into a composite laminate. After each insertion the feed thread is severed and there is thus no need to sharply bend the thread. However the strength of the joint using many short threads is clearly inferior to stitching with a continuous thread.

In U.S. Pat. No. 6,729,251 B2 Nishikawa et al. disclose a thread regulating device relating to a multi-needle chain stitch machine.

While some of the mechanisms seen in the prior art could be used in a machine intended for composite threads, there is not seen a machine that fully relates to the requirements of stitching with a composite thread while avoiding small bend radii and preventing friction of the sewing thread in the sewing needle as a result of thread being pulled through the needle while stitching is in progress.

Furthermore the mechanisms seen are both above and below the fabric being stitched. The idea of eliminating the thread mechanism below fabric level is seen only in the Leska patent which makes no provision for brittle threads.

OBJECTS OF THE INVENTION

It is therefore one of the objects of the present invention to obviate the disadvantages of prior art machines and to provide a mechanism which is specifically configured to use high performance threads.

It is a further object of the present invention to allow operation without incurring any friction of the sewing thread in the needle.

It is a further object of the present invention to allow operation without the thread sliding back and forth in the needle eye.

SUMMARY OF THE INVENTION

The present invention achieves the above objects by providing a sewing mechanism having a needle for stitching a brittle fiber thread through at least one layer of a fibrous fabric, said mechanisms for supplying said sewing thread to the needle on each edge thereof while the needle penetrates the layer or layers of fibrous fabric, thread supply being controlled to equalize the supply on both sides of said needle to prevent axial movement of said thread relative to said needle while said needle moves downwards, said mechanism further supporting a revolving spool of a second thread and arranged to insert said second thread through a loop formed by said sewing thread at the remote side of said layer of fibrous fabric.

In a preferred embodiment of the present invention there is provided a sewing mechanism having a needle for stitching a brittle fiber thread through at least one layer of a fibrous fabric, said needle having an open eye proximate to the needle point for receipt and release of said sewing thread, said mechanisms for supplying said brittle thread to said needle on each edge thereof while said needle penetrates said layer of advanced fiber fabric, thread supply being controlled to equalize the supply on both sides of said needle to prevent axial movement of said thread relative to said needle while said needle moves downwards, said machine further supporting a revolving spool of a second thread and a mechanism arranged to insert said thread through a loop formed by said fiber thread at the remote side of said layer of fibrous fabric.

In a most preferred embodiment of the present invention there is provided a sewing mechanism having a first vertical axis needle for stitching with a brittle sewing thread through at least one layer of a fibrous fabric, said first needle having an open eye proximate to the needle point for receipt and release of said brittle sewing thread, a second mechanism for supplying said sewing thread to said first needle on each edge thereof while said first needle penetrates said layer of fibrous fabric, sewing thread supply being controlled to equalize the supply on both sides of said first needle to prevent axial movement relative to said first needle of said sewing thread during downward movement of said first needle, said mechanisms being further equipped with a third mechanism disposed below said fabric, said third mechanism including a second needle disposed at an angle of 60°-120° to said first needle and being axially driven to pierce said fabric and to insert a loop of a thread through said loop formed by said sewing thread at the lower side of said layer of the fibrous fabric, and to retract to a position above the upper surface of said fibrous fabric before said fibrous fabric is moved to the following stitching station.

Yet further embodiments of the invention will be described hereinafter.

As will become evident by looking at the diagrams herein, the upper first needle is free of the sewing thread at a time the fibrous fabric is being moved between stitches. This time period is used by the mechanism to advance the sewing thread. Unlike a conventional sewing machine where an upper thread is drawn through an eye of a needle, in the present invention there is hardly any axial movement of the sewing thread relative to the said first needle after contact has been established between the said first needle and sewing thread.

The novelty of the present mechanism lies in the actions carried out by the various catchers, grippers and needles, and not in the mechanisms needed to drive these tools in the required manner. For this reason the drive mechanisms, which can be prior art, are not detailed in the present specification

SHORT DESCRIPTION OF THE DRAWINGS

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

In the drawings:

FIG. 1 is a diagrammatic side view of a preferred embodiment of the sewing machine according to the invention;

FIG. 2 is a diagrammatic side view of a second embodiment of the thread feed mechanism;

FIG. 3 is a diagrammatic side view of the needle forming a loop in the brittle thread;

FIG. 4 is a diagrammatic side view of a device inserting a loop of another thread through a loop of the brittle thread;

FIG. 5 is a diagrammatic side view of a second embodiment of the device inserting a loop of a second thread through a loop of the brittle thread;

FIG. 6 is a diagrammatic side view of a catcher hook capturing the second thread;

FIG. 8 is a diagrammatic view of a machine wherein the second thread is threaded into the needle above the fabric; and FIG. 9 is a diagrammatic side view of an arrangement using only a brittle thread.

FULL DESCRIPTION OF THE INVENTION

Figure 7:
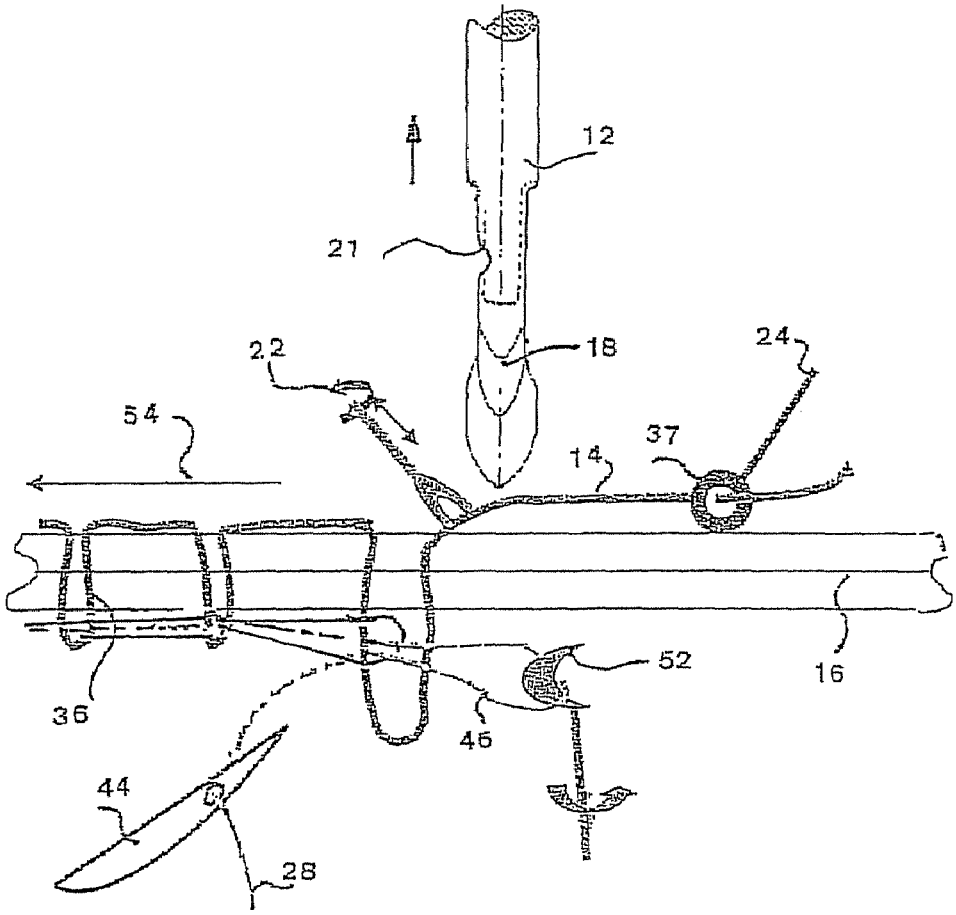
FIG. 7 is a diagrammatic side view of the mechanism after the needle has returned to its upper position.

There is seen in FIG. 1 a sewing machine 10 having an axially-reciprocating needle 12 for stitching a brittle fiber thread 14 through two layers of an advanced fiber fabrics 16.

The needle 12 has an open eye 18 proximate to the needle point 20 for receipt and release of the brittle fiber thread 14. The needle 12 is advantageously provided with a side indentation 21. The indentation 21 is disposed along a horizontal axis when the needle is held on a vertical axis and is located at a height to be accessible from the underside of the fabrics 16 when the needle 12 is in its lowest position. As will be evident from examination of FIG. 4, the indentation 21 is convenient for allowing passage of the lower needle-like hook element 44 to insert a loop 46 of thread 28.

The machine 10 has mechanisms 22, 24 for supplying the thread 14 from a spool 25 to the needle 12 on each edge thereof while the needle 12 penetrates two layers of fabrics 16. Thread supply is controlled to equalize the supply on both sides of the needle 12 and to prevent axial movement of the thread 14 relative to the needle while the needle 12 moves downwards.

The machine 10 further supports a revolving spool 26 of a second thread 28. As will be illustrated in FIG. 4, a third mechanism 30 functions to insert the second thread 28 through a loop 32 formed by the fiber thread 14 at the remote (lower) side of the fabrics 16.

The sewing machine 10 is arranged to operate in a speed range of 50 up to 500 stitches per minute.

The thread may be shaved off after the manufactured component has been cured or solidified.

With reference to the rest of the figures, similar reference numerals have been used to identify similar parts.

In operation the mechanisms are configured to function as follows

A. As seen in FIG. 1, the needle 12 descends to an intermediate depth to pierce the fabrics 16 and to form an aperture 34 therein.

B. The first mechanism 22, disposed at least in part between the needle 12 and previously formed stitches 36, pulls a length of the brittle thread 14 as required for a complete stitch cycle from the spool 25 and through a thread guide and supply mechanism 24 disposed on the side of the needle 12 opposite to the first mechanism 22. The active component of the mechanism 24 is a ring 37 through which the thread passes. The ring 37 brings the thread 14 into contact with the needle 12 before the thread is captured thereby and guides the thread away from the needle when the needle is about to enter the fabrics 16. The quantity of thread 14 supplied takes into account the thickness of the fabrics being stitched. Timing is arranged that the needed thread length is supplied before the needle 12 engages the thread 14.

FIG. 2 shows a second embodiment of mechanisms 38, 40 for supplying the thread 14 from a spool 25 to the needle 12. Theses mechanisms supply and guide the thread in a manner similar to mechanisms 22, 24 as mentioned with reference to FIG. 1.

C. As illustrated in FIG. 3, the first mechanism 22 releases the brittle thread 14 and withdraws. To ensure that the thread 14 is captured by the needle eye opening 18, the mechanism 24 guides the thread 14 into contact with the face of the needle 12 and the opening 18 to the needle eye.

D. The needle 12, having captured the brittle thread 14, descends to its maximum lowest position to form a loop 32 of the thread 14, substantially below the lowest surface of the fabrics 16.

E. As is seen in FIG. 4, a third mechanism 30 functions to insert the second thread 28 through the loop 32 formed by the thread 14 at the remote (lower) side of the fabrics 16. A needle-like hook element 44 disposed under the fabrics 16 collects the loop 46 of thread 28 and pushes the loop 46 through the loop 32 of the brittle thread 14.

An alternative arrangement to that seen in FIG. 4 is shown in FIG. 5. A standard sewing needle 48 is threaded with the thread 28. A mechanism 50 drives the needle 48 to operate underneath the fabrics 16 and carries the loop 46 through the loop 32 of the brittle thread 14.

F. Turning now to FIG. 6, an open catcher element 52 also seen in engages the second thread loop 46 at a position where the loop 46 projects through the loop 32 of the brittle thread 14; while the needle-like hook element 44 retreats to its starting position.

G. There is depicted in FIG. 7 the machine configuration after a stitch has been completed. The needle 12 returns to its highest position and a mechanism 54 advances the fabrics 16. The mechanism 54 is similar to the mechanism used in common sewing machines.

After the fabrics 16 has advanced the machine is ready to start the next stitching cycle.

FIG. 8 illustrates a sewing machine, wherein the second thread is threaded through the needle above the fabric. The mode of operation remains as described.

FIG. 9 refers to a sewing machine which is to carry out stitching using only one thread, the thread being a brittle fiber thread 14.

Securing means are provided to prevent thread pull-out for thread loops 36 formed during stitching and projecting beyond the remote side of the fabrics 16.

In the shown embodiment the stitches are secured by a secondary process successive to stitching, which in the present example comprises the adding of an epoxy coating 70 to the lowest face of the lower fabric 16 after stitching has been completed.

The scope of the described invention is intended to include all embodiments coming within the meaning of the following claims. The foregoing examples illustrate useful forms of the invention, but are not to be considered as limiting its scope, as those skilled in the art will be aware that additional variants and modifications of the invention can readily be formulated without departing from the meaning of the following claims.

We claim:

1. A sewing mechanism comprising:

a first mechanism at a first side of a sewing needle for pulling a length of a sewing thread required for a complete stitch cycle before said needle engages said thread; and a second mechanism at a second side of a sewing needle for supplying said required length of sewing thread to the sewing needle, wherein said first and said second mechanisms are configured for keeping said sewing thread under a controlled tension in a manner that prevents axial movement of the said thread relative to the said needle while said needle is moving from a first side of at least one layer of fabric to a second side of said at least one layer of fabric, said needle having an open eye proximate to the needle point for receipt and release of said thread.

2. The sewing mechanism as in claim 1 wherein the sewing thread may be brittle or sensitive to friction.

3. The sewing mechanisms as in claim 1 wherein the needle can receive and release the thread above the fabric or below the fabric.

4. The sewing mechanism as in claim 1 wherein the fabric includes a fibrous material of a list comprising glass, ceramic, carbon, graphite, boron, or a combination thereof.

5. The sewing mechanism as in claim 1 wherein the fibrous material is impregnated with other material or materials.

6. The sewing mechanism as in claim 1 wherein the fabric includes leather or plastic film or a combination thereof.

7. The sewing mechanism as in claim 1 wherein additional mechanism of revolving spool is attached having a second thread which is inserted through the loop formed by the thread that was guided through the fabric by the sewing needle.

8. The sewing mechanism as in claim 7 wherein the second thread is made of any organic or inorganic material.

9. The sewing mechanism as in claim 7 wherein the second thread is threaded through a conventional type sewing machine needle arranged to reciprocate at the second side of the fabric.

10. The sewing mechanism as claimed in claim 1, wherein said needle is provided with a side indentation along a horizontal axis when said needle is held on a vertical axis, said indentation being located at a height to be accessible from the underside of said fabric when said needle is in its lowest position.

11. The sewing mechanism as claimed in claim 1, wherein stitching is carried out using only one thread, said thread being a brittle fiber thread, securing means for thread loops formed during stitching and projecting beyond said second side of said fabric being optionally secured by a secondary process successive to stitching.

12. The sewing mechanism as claimed in claim 1, wherein said mechanisms are configured to function as follows:

said needle descends to an intermediate depth to pierce the fabric and to form an aperture therein;

a first mechanism, disposed at least in part between said needle and previously formed stitches, pulls a length of said sewing thread as required for a complete stitch cycle from the thread supply mechanism through a thread guide device disposed on the side of said needle opposite to said first mechanism;

said first mechanism releases said sewing thread and withdraws;

said needle captures said sewing thread, descends to its maximum lowest position to form a loop of said sewing thread substantially below the lowest surface of said fabric;

a gripper element disposed under said fabric collects a loop of a second thread and pushes same through said loop of said sewing thread;

an open catcher element engages said second thread loop at a position where said second thread loop projects through said loop of said sewing thread;

said gripper element retreats leaving said second thread loop projecting through said loop of said sewing thread;

said needle rises to its maximum upper position; and said fabric is mechanically advanced by one stitch pitch and the stitching process is repeated.

13. A sewing machine having a first vertical axis needle for stitching a brittle fiber thread through at least one layer of a fiber fabric, said first needle having an open eye proximate to the needle point for receipt and release of said brittle fiber thread, said machine having a first and second mechanisms for supplying to said needle, before said needle engages said thread, a length of said fiber thread required for a complete stitch cycle, wherein while said first needle penetrates said layer of fiber fabric, tension thread supply being controlled to equalize the tension on both sides of said first needle to prevent axial movement relative to said needle of said fiber thread during downward movement of said first needle, said machine being further equipped with a third mechanisms disposed above said fabric, said third mechanism including a second needle disposed at an angle of 60°-120° to said first needle and being axially driven to pierce said fabric and to insert a loop of a second thread through said loop formed by said brittle fiber thread at the lower side of said layer of advanced fiber fabric, and to retract to a position above the upper surface of said fabric before said fabric is moved to the following stitching station.

* * * * *